United States Patent [19]

Ueno

[11] Patent Number: 4,564,304

[45] Date of Patent: Jan. 14, 1986

[54] TYPEWRITER WITH RESETTING FUNCTION FOR MARGIN POSITION AND TAB POSITION

[75] Inventor: Hideo Ueno, Nagoya, Japan

[73] Assignee: Brother Kogyo Kabushiki Kaisha, Nagoya, Japan

[21] Appl. No.: 593,235

[22] Filed: Mar. 26, 1984

[30] Foreign Application Priority Data

Apr. 12, 1983 [JP] Japan ..... 58-64327

[51] Int. Cl.[4] ..... B41J 19/60

[52] U.S. Cl. ..... 400/279; 400/70

[58] Field of Search ..... 400/279, 54, 70

[56] References Cited

U.S. PATENT DOCUMENTS 4,279,523 7/1981 Ringle ..... 400/70

FOREIGN PATENT DOCUMENTS 126474 9/1980 Japan ..... 400/54

102378 6/1982 Japan ..... 400/54

OTHER PUBLICATIONS

Conly et al., "Job Interrupt . . . ", IBM Technical Disclosure Bulletin, vol. 25, No. 1, pp. 249–250, 6/82.

Howell et al., "Temporary Function Retention", IBM Technical Disclosure Bulletin, vol. 25, No. 2, pp. 684–689, 7/82.

McCray, "Tab Stop Storage", IBM Technical Disclosure Bulletin, vol. 18, No. 10, p. 3353, 3/76.

*Primary Examiner*—William Pieprz

*Attorney, Agent, or Firm*—Moonray Kojima

[57] ABSTRACT

When data entered from a keyboard of a typewriter is stored in a text memory and a text is created, the text creation work may be stopped temporarily. When a text is created, after stopping the text creation, in continuation to that stored already in the text memory, margin information and tab information in the text already stored in the text memory are retrieved in the text from the beginning to the end, the content of the register to store the margin information and tab information, is rewritten depending on the retrieved margin information and tab information.

4 Claims, 5 Drawing Figures

START

STOR.MARG/TAB MAR WORK/MARG/ TAB REGISTER
S6
SET TEXT MEM.CTR. TO START POSITION
S7
LT/RT MARGIN SET?
S8
NO
YES
S9
TEXT MEMORY COUN TER + 1
S13
TAB SET/CLEAR ?
NO
YES
S14
TEXT MEMORY COUN- TER + 1
S15
REWRITE WORK TAB REGISTER
S10
REWRITE WORK MAR- GIN REGISTER
TEXT MEMORY COUN- TER + 1
S11
S12
NO
TEXT END?
YES
END

TYPEWRITER WITH RESETTING FUNCTION FOR MARGIN POSITION AND TAB POSITION

BACKGROUND OF THE INVENTION

1. Field of Invention

This invention relates to typewriters with text memory, and more particularly to means and/or methods of resetting of margin position and tab position in the typewriter when text creation work using a text memory is stopped and then started again.

2. Description of Prior Art

It is known in the art that a typewriter may have a text memory and a text can be stored in that text memory. In such a typewriter, it often occurs that ordinary typewriting work must be performed while the text is being created, using the text memory or that a power source must be interrupted and hence the text creation must be stopped. Setting of margin position or tab position in ordinary typewriting work may be performed at positions different from that at the stopped state of the text creation. When the power source is interrupted and then turned on again, the margin position or tab position is usually set to a prescribed position automatically, and the prescribed position is not necessarily coincident with the margin position or tab position at the stopped position.

Consequently, in the prior art, when text creation is stopped and then started again, the margin position or tab position must be reset to that at the stopped position. This resetting procedure is time consuming and inefficient.

SUMMARY OF THE INVENTION

Accordingly, an object of the invention is to overcome the aforementioned and other deficiencies and disadvantages of the prior art.

Another object is to provide a typewriter with text memory, wherein margin position or tab position may be reset automatically to the positions held at the stopping state of text creation, so that the work although stopped, can be easily started again, without inefficient added manual and other resetting procedures.

DETAILED DESCRIPTION OF PREFERRED EMBODIMENTS

Figure 1:
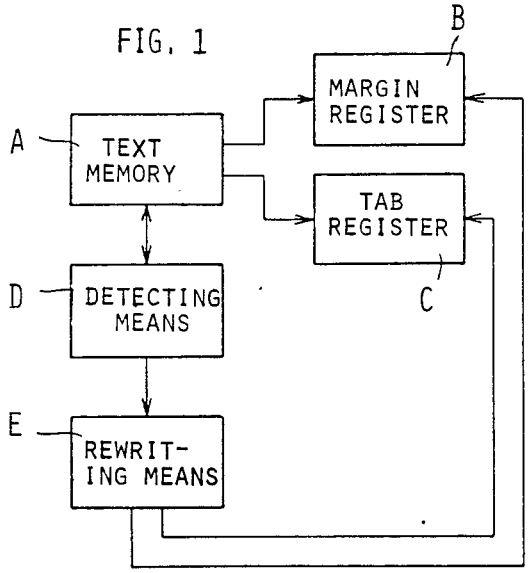
FIG. 1 is a block diagram depicting an illustrative embodiment of the invention.

Referring to FIG. 1, a typewriter according to the invention comprises a text memory A; a margin register B, a tab register C; a detecting means D; and a rewriting means E. Text memory A sequentially stores character data and function data including margin information and tab information, all entered from a keyboard (see FIG. 2, 16). Margin information and tab information are written in margin register B and tab register C, respectively, and the content of these two registers may be rewritten each time margin information or tab information is entered. Detecting means D detects margin information and tab information from the beginning of the text each time the text data stored in text memory A, is read out again. Rewriting means E sequentially rewrites content of margin register B, or tab register C, according to margin information or tab informtion, detected by detecting means D.

Figure 2:
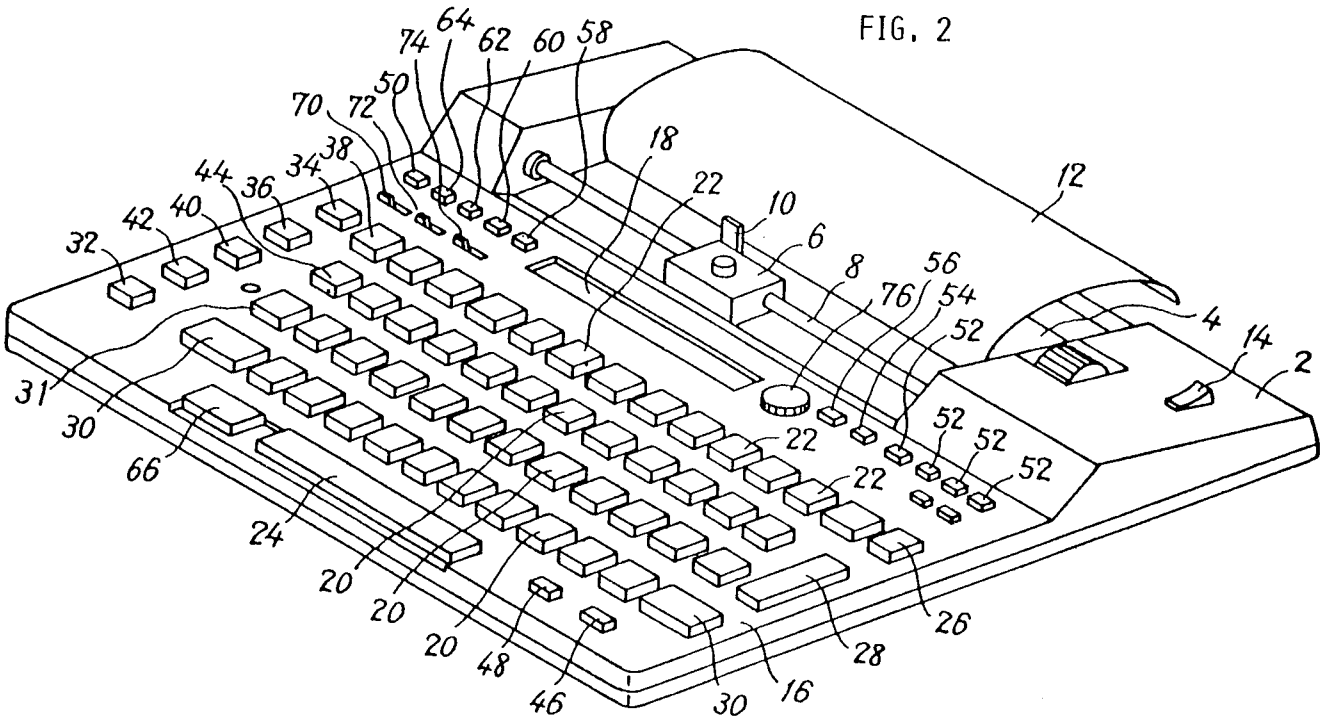
FIG. 2 is a perspective view depicting an electronic typewriter embodying the invention.

FIG. 2 illustrates the appearance of an electronic typewriter embodying the invention. The typewriter comprises a body case 2; a platen 4 rotatably supported by body case 2; and a carriage 6 being movable parallel to the rotational center line of platen 4. Carriage 6 is guided by a guide rod 8 supported parallel to platen 4 by body case 2, and moved in a longitudinal direction of platen 4 by a drive device (not shown). A thermal head 10, as a print head, is fixed to carriage 6, and moved along the printing line on a thermal sensitive paper 12, as a printing paper, held on platen 4, when carriage 6 is moved as described. Carriage 6 is further rotated about guide rod 8 by another drive device (not shown) and this rotation moves thermal head 10 between a print position whereat thermal head 10 is driven against thermal sensitive paper 12 and a separate position whereat it is separated from paper 12. Platen 4 is also driven by a drive device (not shown) to rotate and feed paper 12 in a direction perpendicular to the printing line. A power supply switch 14 is installed on body case 2.

In front and top of body case 2 is provide a keyboard 16 which has a liquid crystal display unit 18, e.g. of 16 columns. On keyboard 16 are further arranged operation members, such as keys, changeover switches, knobs and the like, for operating the typewriter. These operational members are, for example, as listed below.

Alphabetic keys 20 are keys to enter alphabetic characters. Numeric keys 22 are keys to enter numeric characters 1 through 9 and 0. Space bar 24 is a key to advance the carriage 6 along the printing line without printing alphabetic or numeric characters. Back space key 26 is a key to erase the least significant digit of characters displayed on display 18. Line feed key 28 is a key to perform line feed operation, that is, operation of returning carriage 6 to left margin position and rotating platen 4 so as to feed the printing paper in a direction perpendicular to the printing line by an amount corresponding to one printing line. Shift key 30 is a key to select capital letter of characters of alphabetic keys 20 or symbols assigned to numeric keys 22. Shift lock key 31 is a key to hold the selecting state of the capital letter or the like.

Second shift key 32 is a key which is operated simultaneously with any of alphabetic keys 20 and numeric keys 22 so as to select a special symbol other than the alphabetic or numeric character or symbol, such as umlaut or accent ciroconflexe. Left margin key 34 is a key to set the left end of the printing line.

Right margin key 36 is a key to set the right end of the printing line. Margin release key 38 is a key to release the right margin and left margin positions in one printing line. Tab setting key 40 is a key to set tab position in the printing line set by left margin key 34 and right margin key 36. Tab clear key 42 is a key to release the position set by tab setting key 40. Tab key 44 is a key to move carriage 6 to the tab position set by tab setting key 40. Paper feed key 46 is a key to feed thermal sensitive paper 12, as a printing paper, in a direction perpendicular to the printing lines by a prescribed pitch. Paper return key 48 is a key to move paper 12 is a reverse direction to the above mentioned normal paper feed direction.

Repeat key 50 is a key which is operated sequentially to operate alphabetic keys 20, numeric keys 22, space bar 24, back space key 26, line feed key 28, paper feed key 46, paper return key 48 or the like, so as to repeat the operation assigned to such keys. Arithmetic keys 52 are keys to assign arithmetic operations of addition, subtraction, multiplication and division. Equal key 54 is a key to command execution of operations assigned by the arithmetic keys. Clear key 56 is a key to erase any of the alphabetic and numeric characters, arithmetic symbols and arithmetic results, as well as printing control symbols, such as line feed symbol, a paper feed symbol, a printing stop symbol and the like.

Right cursor key 58 is a key to move a cursor displayed on display 18 to the right, i.e. to lower columns. Left cursor key 60 is a key to move the cursor to the left, i.e. to upper columns. Delete key 62 is a key to delete characters or printing control symbols in the column position corresponding to the cursor moved by cursor keys 58 and 60. Insert key 64 is a key to shift characters or printing control symbols displayed on upper columns with respect to the column position corresponding to the cursor moved by cursor keys 58 and 60 towards upper column side and to add characters or printing control symbols to the column position corresponding to the cursor.

Code key 66 is a key which is operated together with any of the above keys, so as to generate code data being different from that generated when such key is operated solely. Line pitch selecting switch 70 is a switch of three position slide type to select the feed pitch of paper 12 when line feed key 28 is operated. Mode selecting key 72 is a switch of three position slide type to select any of the three modes, that is, non-print mode, collection print mode, and direct print mode; wherein a non-print mode is a mode in which key inputted characters or arithmetic results are displayed in display 18 without printing by head 10; wherein a collection print mode is a mode in which each character key inputted is displayed on display 18 and corrected and characters overflowed from display 18 are sequentially printed on paper 12 by head 10; and wherein a direct print mode is a mode in which characters key inputted are displayed on display 18 and printed on paper 12 by head 10 simultaneously with the inputting.

Text memory switch 74 is a switch to select whether or not a text memory is used. Bright angle setting dial 7 is a dial to adjust the bright angle of liquid crystal display 18.

Figure 3:
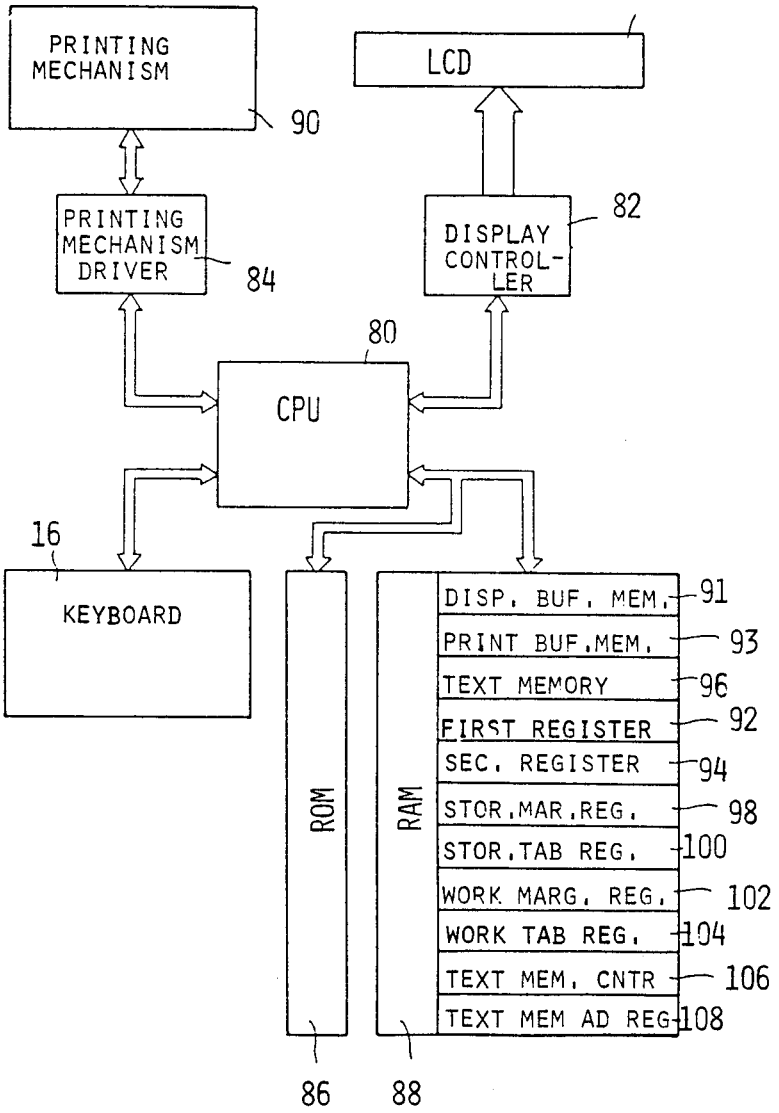
FIG. 3 is a block diagram depicting electronic circuit components of the embodiment.

FIG. 3 is a block diagram depicting an electronic circuit of the illustrative embodiment, wherein number 80 designates a central processing unit (CPU) to which are connected keyboard 16, display controller 82, printing mechanism driver 84, read only memory (ROM) 86 and random access memory (RAM) 88. Display 18 is connected to display controller 82, and together with controller 82, constitutes a display unit. A printing mechanism 90 is connected to printing driver 84, and which together with driver 84 constitutes a printing unit. Printing mechanism 90 includes platen 4, and carriage 6, and the drive device to drive these, as well as thermal head 10.

RAM 88 is provided with a display buffer memory 91, having the same column number as that of display 18. CPU 80 stores code data to display buffer memory 91, in sequence, the code data corresponding to alphabetic and numeric characters, spaces, arithmetic symbols and other symbols as well as printing control symbols such as line feed symbol, paper feed symbol and the like, all entered from keyboard 16, and CPU 80 reads out pattern data corresponding to code data from ROM 86 and supplies the code data to display controller 82.

Display controller 82 is provided with a buffer memory having the same column number as that of display buffer memory 91 and liquid crystal display 18 indicate characters or printing control symbols based on the pattern data fed from CPU 80. RAM 88 is provided with a printing buffer memory 93 corresponding to 20 characters to store printing data entered from keyboard 16. Printing mechanism driver 84 drives head 10 of printing mechanism 90 according to the pattern data read out from ROM 86 by CPU 80 based on data stored in printing buffer memory 93. Printing mechanism driver 84 also drives a motor or the like to drive carriage 6 and platen 4. A program to control operation of the typewriter is stored in ROM 86.

RAM 88 is provided with a text memory 96 which can store about 2K bytes of data, which are character data and function data, including the printing control data. RAM 88 further comprises a first register 92 and a second register 94. First register 92 stores the position of head 10 (distance of head 10 from the original position represented by number of characters which can be printed). Second register 94 stores the value of the count content of first register 92, combined with a value equal to the number of characters, printing control symbols and the like stored in display buffer memory 91. In other words, second register 94 stores the position of the print head assuming that the characters and the like displayed in display 18, are all printed.

Furthermore, RAM 88 comprises a store margin register 98, a store tab register 100, a work margin register 102, a work tab register 104, a text memory counter 106, and a text memory address register 108. The functions of these registers will be described below.

Figure 4:
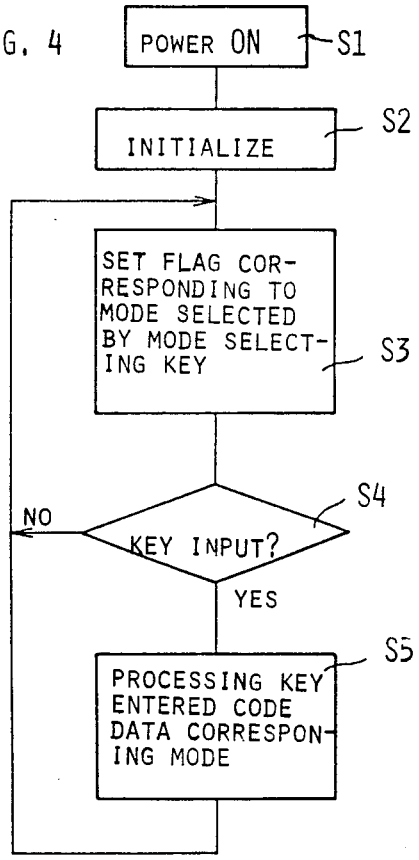
FIG. 4 is a flow chart depicting operation of the embodiment.

FIG. 4 depicts a flow chart illustrating operation of the typewriter of the invention. A power source is turned on at step S1, and subsequently, an initializing procedure is performed at step S2. Furthermore, a flag corresponding to a mode selected by mode selecting key 72 (out of three modes, i.e. non-print mode, collecting print mode, and direct print mode) is set at step S3.

Then, at step S4, determination is repeatedly made as to whether or not the key input exits. If key input exists (i.e.YES) at step S5, processing is performed corresponding to various modes of the key inputted code data. Processing at step S5 is described for example in U.S. patent application Ser. No. 479,810 (now U.S. Pat. No. 4,527,917, July 9, 1985) assigned to the same assignee as hereof, and hence details thereof are omitted hereat for sake of convenience, but a procedure closely related to step S5 and more concerned with the invention will be described with reference to FIG. 5.

If the text memory switch 74 (see FIG. 2) is turned ON, text memory 96 is ready for use. Text memory 96 may be used in any of the following modes: non-print mode, collection print mode, and direct print mode. After text creating work is performed using text memory 96 in a non-print mode or collection print mode, then, text memory switch 74 is turned off. At other times, the text memory 74 can be turned ON. According to this operation, data stored in display buffer memory 91 of RAM 88, is written in text memory 96, in a non-print mode and printed and written into text memory 96 in a collection print mode.

In case where ordinary typewriting work is finished, text memory switch 74 is turned ON again and code key 66 and alphabetic key 20 of letter "a" are simultaneously operated. This operation executes processes shown in the flow chart of FIG. 5.

Figure 5:
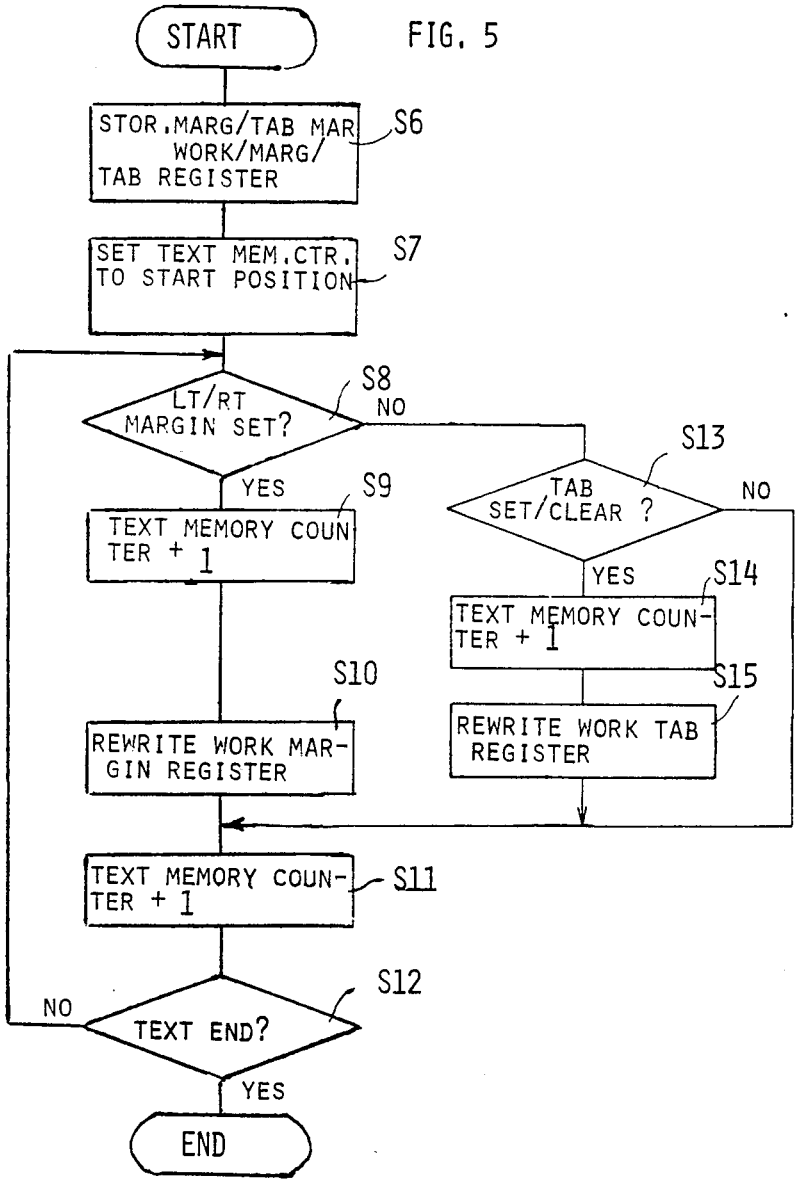
FIG. 5 is a flow chart depicting processing routines closely related to the step 5 of FIG. 4.

In FIG. 5, first, at step S6, the contents of store margin register 98 and store tab register 100, in RAM 88, is written into work margin register 102 and work tab register 104 in text memory 96. At a subsequent step S7, text memory counter 106, in RAM 88, is set in first address of storage region intended as text memory 96. Text memory counter 106 designates address for writing or reading data of text memory 96.

At step S8, determination is made whether or not the data stored in the first address is margin information, to represent left margin or right margin. If the determination is YES, at step S9, the contents of text memory counter 106 is increased by one, and further at step S10, work margin register 102 is rewritten. Subsequently, at step S11, the contents of text memory counter 106 is further increased by 1.

At step S12, a determination is made whether or not the content of text memory counter 106 coincides with the contents of text memory address register 108, which stores the last address of the text at a stopping state of the text creation. If the determination is NO, the program execution is returned to step S8. The content of text memory counter 106 is increased by one in each of steps S9 and S11, resulting in an increase of two. This increase is necessary for the reason as discussed below. Although an ordinary character is stored in 1 byte, margin information comprises data of left margin or right margin and data indicating the margin position and therefore is stored in 2 bytes.

If the determination in step S8 is NO, at step S13, determination is made whether or not the information is tab information of tab set or tab clear. If the determination is YES, at step S14, the content of text memory counter 106 is increased by one, and then at step S15, work tab register 104 is written and further steps S11 and S12 are executed. Since the tab information is also stored in 2 bytes, text memory counter 106 is increased by two each time one tab information is read out. The tab information has tab set data and tab clear data. Since each of left margin position and right margin position, cannot be set at two positions simultaneously, if new margin information is written, work margin register 102 may clear the previous margin information. However, two or more tab positions can be set at plural positions simultaneously.

If the determination in step S13 is NO, the read data is character data and at step S11, text memory counter 106 is increased by one and the program is returned to step S8.

The above mentioned procedures are repeated and if the contents of text memory counter 106 becomes equal to the value at the stopping state of the text creation work (content of the text memory address register 108) the determination in step S12 is YES whereby the reading work of margin information and tab information in text memory 96 is completed.

As clearly understood from the above, each time the margin information or tab information is read out as the data stored in text memory 96, is read out, the contents of work margin register 102 or work tab register 104 is rewritten. When reading of the stored text data is completed, the content of work margin register 102 and tab work register 104 becomes equal to the contents at the stopping state of text creation. Consequently, a typist need not reset work margin register 102 or work tab register 104 to values at the time of stopping of the text creation, but, instead, may continue text creation as if there were not stopping state.

The foregoing description is illustrative of the principles of the invention. Numerous modifications and extension thereof would be apparent to the worker skilled in the art. All such modifications and extensions are to be considered to be within the spirit and scope of the invention.

What is claimed is:

1. A typewriter capable of resetting margin position and tab position after interruption of text creation, comprising a printing unit for performing printing operation using a printing head supported for movement along printing lines of a printing paper held on a paper holding member;

a keyboard having a plurality of character keys, symbol keys and function keys, said function keys including a text memory key and text continuation means including a code key and, said text continuation means being concurrently with another key operable to enable continuing of text creation after interruption of text creation without manual resetting of said margin position and said tab position;

a text memory, responsive to operation of said text memory key, for sequentially storing printing data and function data, including margin information and tab information, entered from said keyboard by operation of said character keys, symbol keys and function keys of said keyboard;

a work register comprising a work margin register and a work tab margin register, for registering respectively said margin information and said tab information upon entry thereof through said text memory and responsive to below recited sequential rewriting means, for rewriting said margin and tab information;

reading means, responsive to turning ON of said text continuation means, for sequentially reading out said printing data and said function data, including said margin information and said tab information, stored in said text memory and in said work register;

detecting means for detecting whether data read out by said reading means is margin information or tab information; and sequential rewriting means, responsive to said detecting means detecting margin information or tab information read out by said reading means, for sequentially rewriting contents of said work register to be equal to the contents at the time of said interruption.

2. The typewriter of claim 1, wherein said reading means includes means for starting use of said text memory.

3. The typewriter of claim 1, wherein said reading means includes a text memory counter which is set to begin text count at start of text reading and which counts each time data is read from said text memory.

4. The typewriter of claim 3, wherein said reading means further includes a register for storing the end of text and repeats the text until the contents of said text memory counter coincides with the contents of said register.

* * * * *